United States Patent [19]

Thomas

[11] Patent Number: 4,490,923

[45] Date of Patent: Jan. 1, 1985

[54] MICROWAVE CLOTHES DRYER

[76] Inventor: Perry W. Thomas, 12708 12th St., Grandview, Mo. 64030

[21] Appl. No.: 445,005

[22] Filed: Nov. 29, 1982

[51] Int. Cl.[3] ..... F26B 23/08

[52] U.S. Cl. ..... 34/1; 219/10.55 R

[58] Field of Search ..... 34/133, 4, 1, 39, 40; 219/10.55 R

[56] References Cited

U.S. PATENT DOCUMENTS

| | | | |
|---|---|---|---|
| 2,869,346 | 1/1959 | Brucken | 34/133 |
| 3,439,431 | 4/1969 | Heidtmann | 34/1 |
| 3,854,219 | 12/1974 | Staats | 34/1 |
| 4,289,945 | 9/1981 | Kristof | 219/10.55 R |
| 4,334,136 | 6/1982 | Mahan et al. | 34/1 |

*Primary Examiner*—Larry I. Schwartz

*Attorney, Agent, or Firm*—Kokjer, Kircher, Bradley, Wharton, Bowman & Johnson

[57] ABSTRACT

A clothes dryer comprising a stationary container with means for the passage of air therethrough, and a source of electromagnetic energy for generating microwaves through the clothing to dry the latter. A microwave stirrer in the magnetron wave guide randomly directs the microwaves for uniform distribution through the clothing and the frusto-conical shape of the clothing container cooperates to reflect the microwaves to enhance the drying operation.

2 Claims, 2 Drawing Figures

MICROWAVE CLOTHES DRYER

Figure 2:
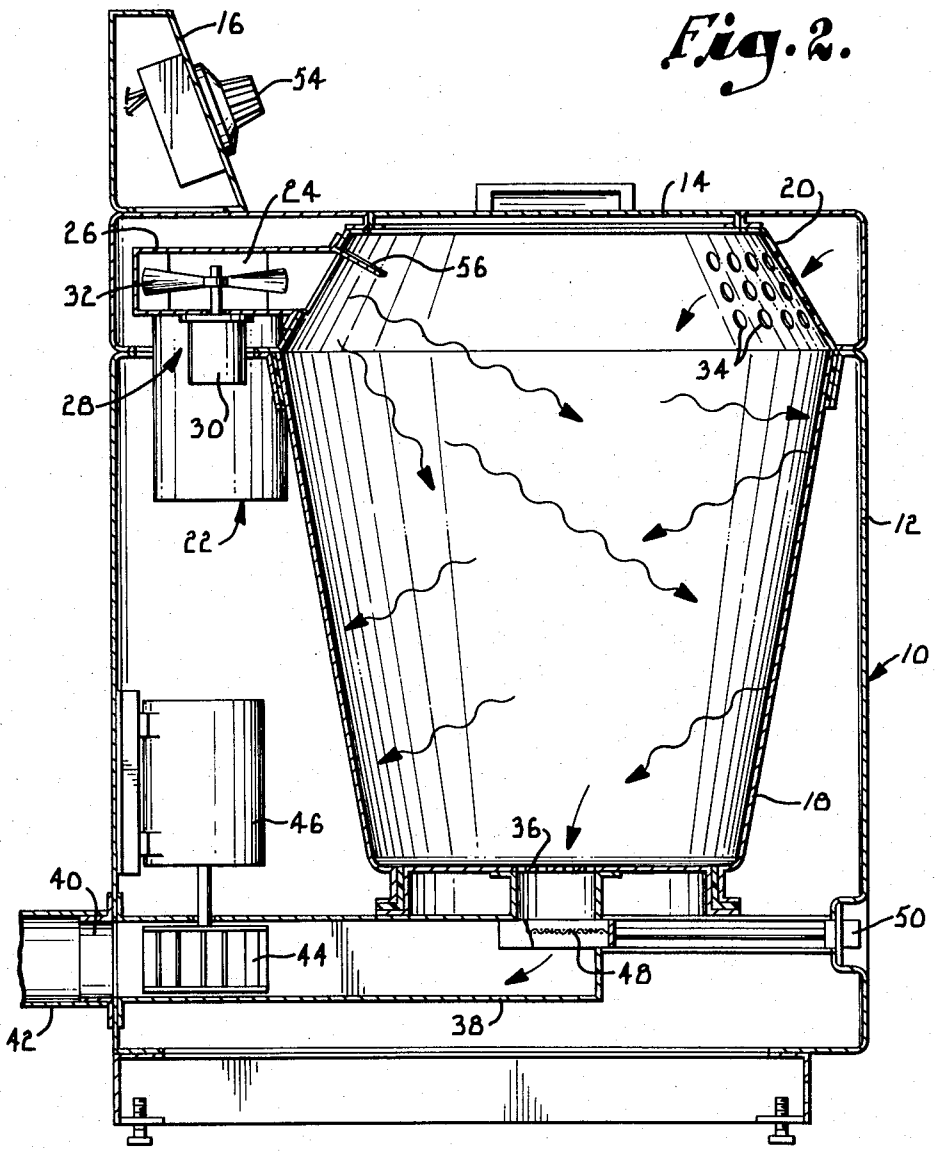

This invention pertains to laundry equipment, and more particularly to a clothes dryer which utilizes electromagnetic energy to generate the heat required for driving water vapor from the clothing fabric.

Conventional clothes dryers use electric resistance elements or gas flame to heat air which is drawn through the damp clothing in the dryer. The hot air is circulated through the clothing to elevate the temperature of the water in the fabric and to evaporate the water. The water vapor is discharged with the exhaust air stream.

A disadvantage with conventional clothes dryers resides in the fact that the heat generating means requires considerable energy and the heat therefrom is difficult to control. Further, since the means for evaporating the water from the fabric is a current of air, it is necessary for the clothing to be agitated or tumbled to uniformly expose the clothing to the hot air. Relatively complicated and expensive thermostat controls are required to insure that the clothing is not scorched from the heated air and it is difficult to provide the kind of control over the drying process which is required for adequately drying delicate materials.

It is a primary object of the present invention to provide a dryer having an electromagnetic heat souce which is relatively easy to control to effect the appropriate drying action required for a wide range of fabrics.

It is another important object of the present invention to provide a dryer wherein it is unnecessary to tumble the clothing, thereby significantly reducing the cost of operation and also reducing the noise level ordinarily associated with the operation of a conventional clothes dryer.

Still a further object of the invention is to provide a dryer which is capable of more uniform heat distribution throughout the drying chamber than has generally heretofore been available, thereby enhancing the drying operation and reducing the risk of damage or fire in the chamber.

Figure 1:
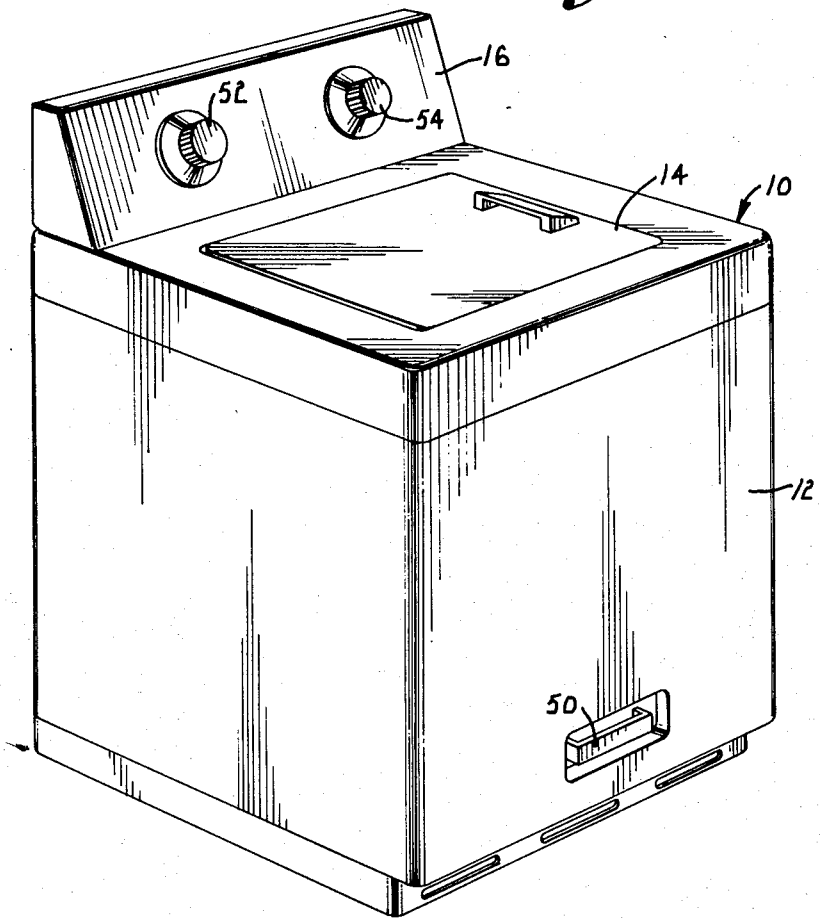

These and other important aims and objectives of the present invention will be further discussed or will become apparent from the following description and explanation of the drawing, wherein:

FIG. 1 is a front perspective view of a clothes dryer embodying the principles of this invention; and FIG. 2 is an enlarged, detailed vertical cross-sectional view through the dryer of FIG. 1.

A clothes dryer embodying the principles of this invention is broadly designated by the reference numeral 10 and includes a cabinet 12 provided with a door 14 and an upwardly projecting control panel 16. A generally frustro conical container 18 preferably formed of coated sheet steel is mounted in the cabinet immediately beneath door 14. An inwardly inclined transversely circular collar 20 forms a part of container 18 and extends upwardly into close proximity to door 14. Container 18 is open at the top and is closed by a hinged door 14 so that the latter serves as an access port for the deposit of clothing into the container or the removal of dry clothes therefrom.

A source of microwave energy in the form of a magnetron 22 is mounted in cabinet 12 and the antenna 24 thereof communicates with the interior of container 18 by means of a wave guide 26 opening into the interior of container 18. A stirrer 28 comprising an electric motor and a fan like blade 32 cooperates with magnetron 22 and wave guide 26 to direct the microwaves at random angles into the interior of container 18. Stirrer 28 is strategically located so that the microwaves are reflected by the fan blades which are rotated by motor 30. This causes the microwaves to reflect at varying angles into container 18.

The magnetron and related components are of conventional construction such as are commonly utilized in microwave ovens. The details of construction of the generator of the form of electromagnetic energy used in dryer 10 is considered to be within the skill of the art and need not be described herein in detail.

Air inlet means for container 18 includes a plurality of openings 34 in collar 20. Openings 36 in the base of the container are connected to an outlet duct 38 for conducting air from the container to the exterior of cabinet 12. A collar 40 is mounted on the cabinet in position to receive an air outlet hose 42.

A fan 44 is interposed in duct 38 and is operated by motor 46 for drawing air through inlet openings 34, through the container and out openings 36 for discharge through the duct. A filter 48 is positioned below openings 36 and across duct 38 to trap any objectionable lint which may be generated in the clothes drying operation. A handle 50 is secured to filter 48 and projects outwardly from cabinet 12 for convenient installation of the filter and removal for periodic cleaning.

In operation, wet clothes to be dried are inserted into container 18 through door 14. Controls 52 and 54 are operably coupled with the electrically operated components of dryer 10 so that the operator can select the magnitude of microwave energy to be directed into the container and also the time cycle during which such energy is to be generated. The controls also operate motor 46 to draw air through the dryer during the drying process. The stirrer 28 is electrically coupled with the magnetron 22 so that it operates constantly during the period that microwaves are generated.

Electromagnetic energy in the form of microwaves is passed through the clothing to elevate the temperature of the moisture contained in the fabric and the water vapor generated by this action is drawn from the dryer container. The generally frustro-conical shape of the container, together with the slanted collar 20 serves to reflect the microwaves in a manner effecting good general distribution throughout the clothes in the container. This obviates any necessity for tumbling the clothing during the drying operation.

It is contemplated that all of the construction throughout should be of sheet metal so that the microwaves are reflected within container 18 once they are directed therein by the wave guide. This not only increases the efficiency of operation of the dryer but also shields the operator or those in close proximity to the dryer from any harmful effects from the microwaves. An inwardly and downwardly directed deflector 56 cooperates with wave guide 26 to insure that the microwaves are directed toward the lower region of the tub or container 18 where the radiant energy is required for the drying function.

I claim:

1. A clothes dryer comprising:

a cabinet;

a clothes container mounted in a stationary position in said cabinet for receiving damp clothes, said container having a generally frustoconical side wall which tapers from top to bottom;

means for generating electromagnetic microwave energy;

a waveguide in said cabinet for receiving the microwave energy, said waveguide having an open end which opens into said container adjacent the top thereof to guide the microwave energy into the container for application to the damp clothing therein;

a deflector located adjacent the open end of said waveguide, said deflector inclining downwardly and inwardly into said container and being located above said open end of the waveguide to deflect the microwave energy entering the container generally downwardly and inwardly toward the clothes disposed in the container for effective application of the microwave energy to the clothes; and means for passing air through said container to ventilate the interior thereof and transport moisture out of the container.

2. The invention of claim 1, including:

an access door on a top portion of said cabinet having an open position providing access to the interior of said container;

a collar on top of said container, said collar being tapered from bottom to top and having a top end adjacent said door; and said waveguide being connected to said collar with said open end of the waveguide opening through the collar.

* * * * *